US006227206B1

(12) United States Patent
Sallee

(10) Patent No.: US 6,227,206 B1
(45) Date of Patent: May 8, 2001

(54) FABRIC NAIL APPLICATION HAVING WATER ACTIVATED POLYURETHANE RESIN

(76) Inventor: Debra Sallee, 2016 NE. 65th. St., Seattle, WA (US) 98115

( * ) Notice: Subject to any disclaimer, the term of this patent is extended or adjusted under 35 U.S.C. 154(b) by 0 days.

(21) Appl. No.: 09/637,664

(22) Filed: Aug. 14, 2000

(51) Int. Cl.[7] ..... A45D 31/00
(52) U.S. Cl. ..... 132/200; 132/73
(58) Field of Search ..... 132/200, 73, 73.5, 132/74.5, 285

(56) References Cited

U.S. PATENT DOCUMENTS 2,864,384 * 12/1958 Walter ..... 132/73
4,655,208 * 4/1987 Yoon ..... 128/156
4,860,774 * 8/1989 Becker ..... 132/200
5,607,387 * 3/1997 Martin et al. ..... 602/6

* cited by examiner

*Primary Examiner*—Todd E. Manahan
*Assistant Examiner*—David Comstock
(74) *Attorney, Agent, or Firm*—Goldstein & Canino

(57) ABSTRACT

An artificial nail application system including a plurality of fabric mediums formed in a variety of shapes. The shapes correspond with shapes of fingernails. Each of the fabric mediums have a generally oval configuration with opposed sides. The opposed sides are treated with a water activated polyurethane resin. The opposed sides each have a peel away layer disposed over the polyurethane resin to protect the same from exposure to moisture prior to use. The adhesive coating allows the fabric mediums to be secured to a prepared fingernail surface whereupon water can be applied to the polyurethane resin present on the fabric medium, which then dries within minutes having a smooth, hard, workable surface.

7 Claims, 2 Drawing Sheets

FABRIC NAIL APPLICATION HAVING WATER ACTIVATED POLYURETHANE RESIN

BACKGROUND OF THE INVENTION

The present invention relates to an artificial nail application system and more particularly pertains to creating a strong, smooth artificial nail surface which is ready for finishing with the application of nail polish.

The use of artificial nail devices is known in the prior art. Such systems generally apply application of several chemicals to the nail surface, and a procedure involving several steps in order to create a smooth, artificial nail surface which is suitable for finishing. However, such systems are very messy, generate nauseating and possibly toxic odors, and are quite expensive.

Additionally, artificial nail devices heretofore devised and utilized for the purpose of adhering artificial nails to existing fingernails are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,209,250 to Taeckens discloses a means for attaching fabric artificial fingernails using an adhesive material. U.S. Pat. No. 4,615,348 to Nakata discloses a means for attaching an artificial nail using a composition cured within a short period of time by moisture. U.S. Pat. No. 4,954,190 to Taeckens discloses a means for using artificial fingernail material comprised of pre-cut porous fabric sheets. U.S. Pat. No. 4,913,173 to Hokama discloses a nail process using a fabric layer and cyanoacrylate for curing.

In this respect, the artificial nail application according to the present invention substantially departs from the conventional concepts and designs of the prior art, and in doing so, provides an apparatus primarily developed for the purpose of easily creating a strong, smooth nail surface which is ready for finishing with the application of nail polish, while eliminating multiple steps and toxins.

Therefore, it can be appreciated that there exists a continuing need for a new and improved artificial nail application which can be used by the general public with ease, for creating a strong nail surface which enables nail polish and the like to be properly applied to the nail surface thus created. In this regard, the present invention substantially fulfills this need.

SUMMARY OF THE INVENTION

In the view of the foregoing disadvantages inherent in the known types of artificial nail devices now present in the prior art, the present invention provides an improved artificial nail application. As such, the general purpose of the present invention, which will be described subsequently in greater detail, is to provide a new and improved artificial nail application which has all the advantages of the prior art and none of the disadvantages.

To attain this, the present invention essentially comprises a plurality of fabric mediums formed in a variety of shapes. The shapes correspond with shapes of fingernails/cuticles. Each of the fabric mediums have a generally oval configuration with opposed sides. The opposed sides are treated with an a chemical substance—namely a water activated polyurethane resin. The opposed sides may each have a peel away layer selectively covering the chemical to protect said chemical from being prematurely exposed to moisture. The chemical has an adhesive quality which allows the fabric medium to be initially secured to a fingernail whereupon water can be applied to the chemical to create a hardened workable surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved artificial nail application which has all the advantages of the prior art artificial nail devices and none of the disadvantages.

It is another object of the present invention to provide a new and improved artificial nail application which is inexpensive to produce and as such may be easily and efficiently manufactured and marketed.

It is a further object of the present invention to provide a new and improved artificial nail application which eliminates numerous application and preparation steps, which is odor free and mess free, and provides a superior working surface for the application of finishing products such as nail polish.

An even further object of the present invention is to provide a new and improved artificial nail application which is susceptible of a low cost of manufacture with regard to both materials and labor, and which accordingly is then susceptible of low prices of sale to the consuming public, thereby making such an artificial nail application economically available to the buying public.

It is a still further object of the invention to provide a nail application system which is easily used by the general public while still providing professional results.

Lastly, it is an object of the present invention to provide a new and improved artificial nail application including a plurality of fabric mediums treated with a chemical which is a water-activated polyurethane resin. The chemical is protected from moisture prior to use. The chemical allows the fabric medium to be secured to a prepared fingernail surface whereupon water can be applied to the chemical contained within and covering the fabric medium to activate the same and create a smooth, hardened artificial nail surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
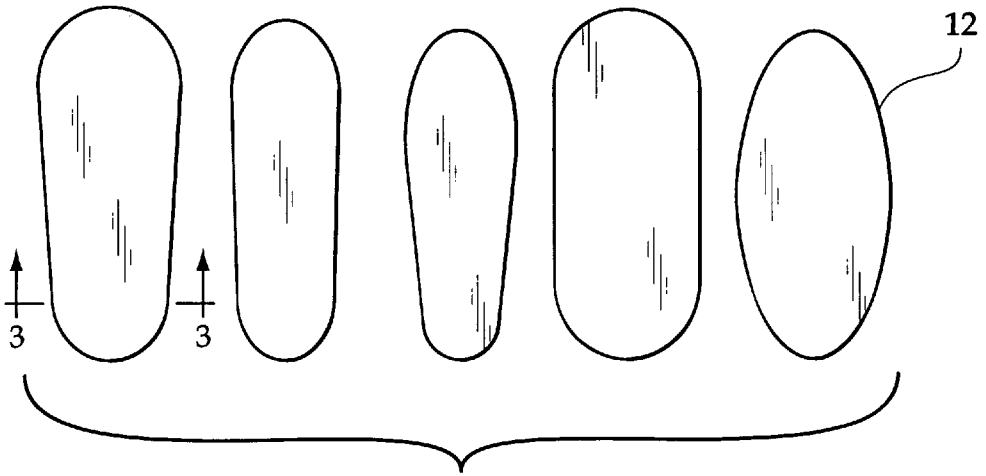
FIG. 1 is a plan view of the preferred embodiment of the artificial nail application constructed in accordance with the principles of the present invention.
Figure 2:
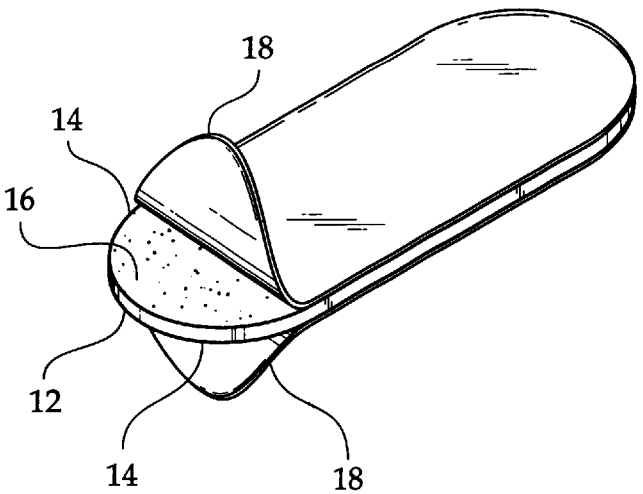
FIG. 2 is a perspective view of one of the fabric mediums of the present invention.
Figure 3:
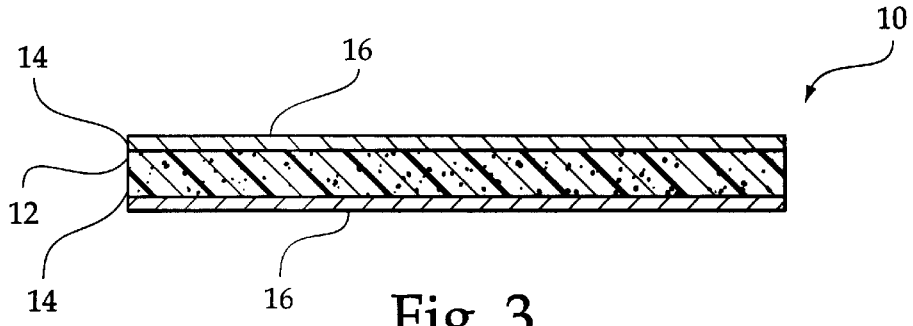
FIG. 3 is a cross-sectional view of the present invention as taken along line 3—3 of FIG. 1.
Figure 4:
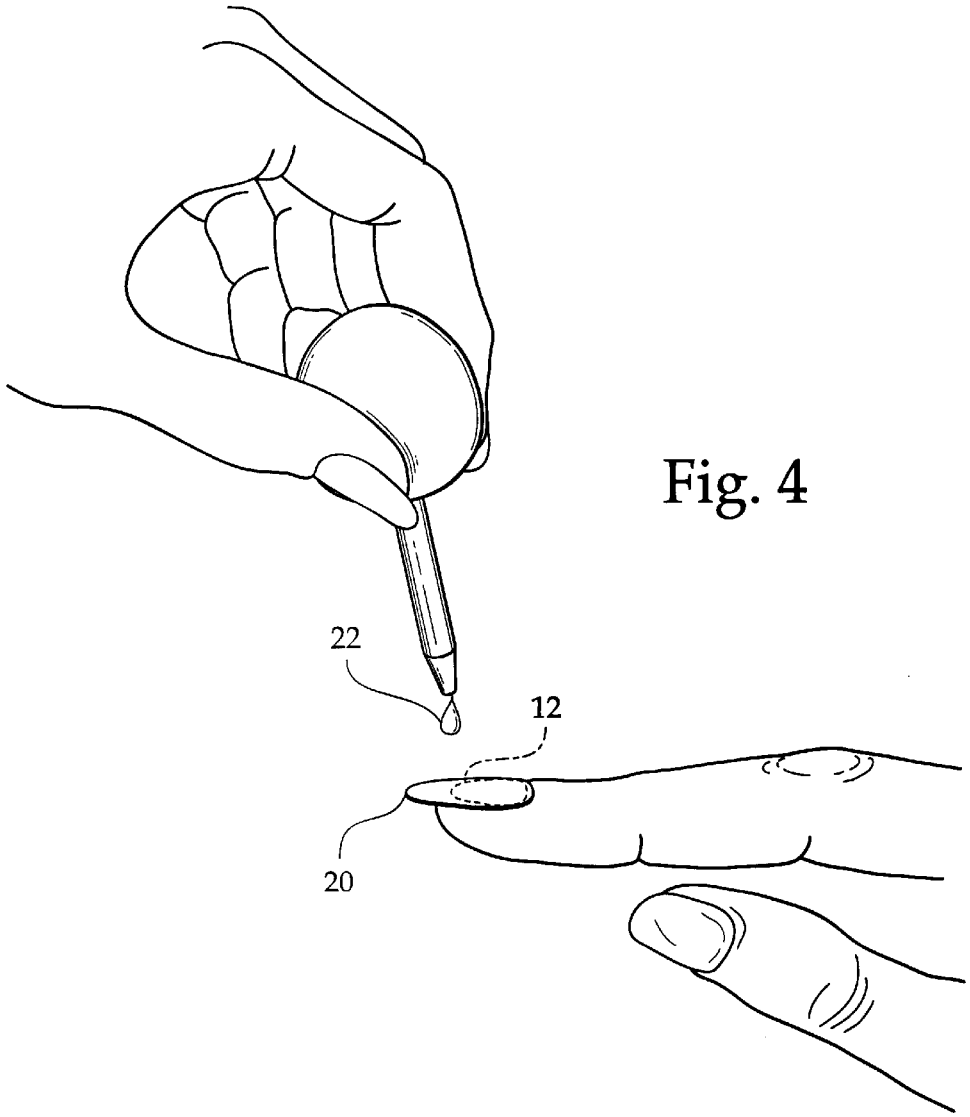
FIG. 4 is a side view of the present invention illustrated in use.

With reference now to the drawings, and in particular, to FIGS. 1 through 4 thereof, the preferred embodiment of the new and improved artificial nail application embodying the principles and concepts of the present invention and generally designated by the reference number 10 will be described.

Specifically, it will be noted in the various figures that the device relates to an artificial nail application for creating a workable surface upon which nail polish and the like can be properly applied. Generally, the system is used on a prepared nail surface. A prepared nail surface is a surface which has been lightly buffed to remove oils. The prepared nail surface may be a plastic artificial nail extension which has been buffed in such a manner to blend with the natural nail, or it may be a natural nail which is prepared for the application of the artificial nail.

The present invention is essentially comprised of a plurality of fabric mediums 12 formed in a variety of shapes. Note FIG. 1. The shapes correspond with shapes of fingernails, in a similar manner that the shapes of artificial nails are configured so as to best fit over a natural fingernail. Each of the fabric mediums 12 have a generally oval configuration with opposed sides 14. The opposed sides 14 are treated with a chemical 16 which is absorbed within the fabric medium 12 and covers the opposed sides 14 thereof.

The chemical 16 is a water activated polyurethane resin. The water activated polyurethane resin, when exposed to water is capable of drying to a hard, smooth surface within minutes. In particular, when used in conjunction with fabric, it adheres the fabric permanently to the nail surface and hardens with a smooth, fiberglass-like outer finish. As the name implies, the polyurethane resin is activated upon contact with water, or even moisture. Accordingly, the resin must be protected from moisture prior to use, to avoid premature curing thereof. A suitable example of a water activated polyurethane resin in found in the product SCOTCHCAST PLUS Casting Tape, manufactured by 3M Corporation.

The manner of protection shown in the drawing figures are a pair of peel away layer 18 the opposed sides 14 disposed over the chemical 16. The peel away layers 18 cover the fabric 12 prior to use, and protect the chemical impregnated therein from moisture. Other systems may be implemented for protecting the chemical prior to use while allowing the fabric medium to be conveniently dispensed. One example would be to provide the fabric medium in a multiple blister pack, wherein each fabric medium is individually contained within one of said blisters and is engulfed in the chemical within said blister. Other packaging possibilities are well within the realm of those of ordinary skill in the art.

The chemical 16 allows the fabric mediums 12 to be secured to a prepared fingernail surface 20 whereupon water 22 can be applied to the chemical 16 to create a hardened workable surface. The fingernail surface 20 is defined by a nail bed on one end, continuing with either a natural free edge or a plastic nail tip extension which has been buffed to blend with the natural nail to provide extra length. The fabric mediums 12 could be trimmed to conform to the nail bed shape prior to the application to the prepared fingernail surface 20 if a suitable existing shape does not already exist. This finished, workable surface then can be shaped as desired and later buffed and polished to a glossy finish—whereupon polish can then be applied.

An overview of usage of the present invention is as follows. The fabric medium is first removed from its packaging, and prepared for application to the prepared nail surface. Accordingly, the fabric medium may be initially trimmed to conform with the nail bed of the fingernail to which it is to be applied. In addition, if the moisture protecting peel away layer is provided, then the peel away layer should be removed from one of the opposed sides. That side is then aligned over the nail bed as desired, and is applied thereto. The fabric medium is smoothed onto the prepared nail surface by manually rubbing the remaining peel away layer. The chemical has an adhesive quality which will maintain the fabric medium in place on the prepared nail surface.

Once the fabric medium is suitably positioned on the nail bed, the chemical is then activated. If the fabric medium is covered by a peel away layer, then such layer should be first removed. To activate the chemical, water is applied to the chemical by applying water to the fabric medium. A slight warming sensation will be experienced. As the chemical dries, a smooth, hard, fiberglass-like surface is formed upon the fabric medium, and the fabric medium is permanently adhered to the nail surface.

Before finishing the artificial nail with nail polish or the like, the newly created artificial nail and fabric medium may be shaped as desired. Generally when the fabric medium is applied to the nail, a "free end" is created beyond the fingernail tip, wherein the fabric medium partially overhangs the new artificial fingernail. Such overhanging fabric would then be hardened at this point. As such, it can be shaped and removed with a common nail file.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An artificial nail application for preparing an artificial nail surface comprising, in combination:

a plurality of fabric mediums formed in a variety of shapes, the shapes corresponding with shapes of fingernails, each of the fabric mediums having a generally oval configuration with opposed sides, the opposed sides being treated with a water activated polyurethane resin, the opposed sides each having a peel away layer disposed over the polyurethane resin for protecting said polyurethane resin from exposure to moisture prior to use, the polyurethane resin allowing the fabric mediums to be secured to a prepared nail surface whereupon water can be applied to the polyurethane resin to interact with said polyurethane resin to form a hardened workable surface upon the prepared nail surface.

2. An artificial nail application method for creating a strong, smooth workable surface on a prepared nail surface, comprising the steps of:

providing a plurality of fabric mediums formed in a variety of shapes, the shapes corresponding with shapes of fingernails, each of the fabric mediums having a generally oval configuration with opposed sides, the opposed sides being treated with a water activated polyurethane resin;

applying the fabric medium to the prepared nail surface; and applying water to the polyurethane resin on and in the fabric medium to create a hardened workable surface by exposing the polyurethane resin to the water.

3. The artificial nail application method as recited in claim 2, wherein the step of applying the fabric medium to the prepared nail surface is preceded by the step of cutting the fabric medium to correspond with a particular fingernail bed shape.

4. The artificial nail application method as recited in claim 3, wherein the step of providing a plurality of fabric mediums further comprises protecting the polyurethane resin on and in the fabric medium from exposure to moisture prior to the step of applying the fabric medium to the prepared nail surface.

5. The artificial nail application method as recited in claim 4, wherein the step of protecting the fabric medium from exposure to moisture further comprises covering each of the opposed sides of the fabric medium with a peel away layer, and the step of applying the fabric medium to the prepared nail surface further comprises removing the peel away layer from one of the opposed sides and then applying said side to the prepared nail surface, and the step of applying water to the polyurethane resin is preceded by removing the peel away layer from the other of said opposed sides.

6. The artifical nail application method as recited in claim 5, wherein the step of applying the fabric medium to the prepared nail surface is followed by the step of manually smoothing the fabric medium by rubbing the fabric medium onto the prepared nail surface.

7. The artificial nail application method as recited in claim 6, wherein the step of applying water to the polyurethane resin is followed by the steps of allowing the polyurethane resin to harden into a smooth artificial nail surface and then shaping said artifical nail surface.

* * * * *